United States Patent [19]

Cano

[11] Patent Number: 4,709,919

[45] Date of Patent: Dec. 1, 1987

[54] EXERCISE MACHINE

[76] Inventor: Richard A. Cano, 1118 Cypress, Pueblo, Colo. 81004

[21] Appl. No.: 369,820

[22] Filed: Apr. 19, 1982

Related U.S. Application Data

[63] Continuation-in-part of Ser. No. 93,046, Nov. 13, 1979, abandoned.

[51] Int. Cl.[4] ..... A63B 21/06

[52] U.S. Cl. ..... 272/117; 272/123; 272/128

[58] Field of Search ..... 272/118, 117, 143, 93, 272/134, DIG. 4, 120–128; 187/20, 8.69, 21

[56] References Cited

U.S. PATENT DOCUMENTS

| | | | |
|---|---|---|---|
| 3,640,527 | 2/1972 | Proctor | 272/118 |
| 4,149,714 | 4/1979 | Lambert | 272/118 |
| 4,216,959 | 8/1980 | Niles | 272/123 |
| 4,249,726 | 2/1981 | Faust | 272/123 |
| 4,253,662 | 3/1981 | Podolak | 272/123 |
| 4,256,301 | 3/1981 | Goyette | 272/123 |
| 4,373,717 | 2/1983 | Lambert | 272/118 X |

FOREIGN PATENT DOCUMENTS

| | | | |
|---|---|---|---|
| 122994 | 8/1901 | Fed. Rep. of Germany | 272/118 |

*Primary Examiner*—Richard J. Apley
*Assistant Examiner*—Robert W. Bahr

[57] ABSTRACT

An exercise machine adapted to selectively provide either a constant resistance or an inertial resistance in response to a force. In one embodiment, a suspended weight is interconnected by a cable suspended from a frame either to a handle or to a heavy barbell. A force applied to the handle experiences constant resistance from the weight, and a force applied to the barbell experiences inertial resistance. In another embodiment, a heavy barbell is connected to a cable suspended by a frame and may be selectively connected to a suspended weight. A force applied to the barbell when the weight is not connected experiences constant resistance from the barbell, and a force applied to the barbell when the weight is connected experiences inertial resistance.

9 Claims, 11 Drawing Figures

EXERCISE MACHINE

This patent application is a continuation-in-part of copending application Ser. No. 93,046, filed Nov. 13, 1979 now abandoned, entitled "Inertial Decelerating Exercise Apparatus", the subject matter of which is hereby incorporated by reference and the benefits of which (including the filing date) are hereby claimed.

BACKGROUND OF THE INVENTION

The present invention relates to a machine for use in exercising a human body.

Most exercise devices utilize constant resistance forces. That is, when the exerciser creates a force in a certain direction against the exercise device, he experiences a resistance, however, the exerciser experiences no resistance in moving the exercise device in a generally opposing direction. The concept of constant resistance is exemplified by a set of barbells, where the exerciser encounters resistance in moving the barbells upwardly, but experiences no resistance in moving the barbells downwardly.

The idea of using inertial resistance for exercising has only recently achieved some prominence and attention in the exercise field. Generally, inertial resistance involves a resistance in a certain direction and a resistance also in a generally opposing direction. As taught by the present invention, the effect of inertial resistance is achieved by a counterbalancing weight. Moreover, when a force ceases to be applied to the object, such as a weight, the object remains stationary and does not move. Thus, it should be appreciated that use of inertial resistance devices during exercising is much safer than using constant resistance devices.

SUMMARY OF THE INVENTION

The present invention relates to a machine for use in exercising a human body which is selectively adaptable for producing either a constant resistance force or an inertial resistance force, especially an inertial resistance force in either one, two or three dimensions. The machine includes a cage-like frame including several frame components that are movable with respect to the other frame components. A plurality of weights are mounted about a vertically translatable relative to the frame. A cable or a plurality of cable segments interconnect the weights and are suspended about the frame by means of pulleys or the like. The cables cross in a selected fashion in a region within the cage which is normally occupied by the user. A ring-like handgrip or the like may be attached to the cable at several locations thereon in such region. The pulleys may be selectively positioned about the frame so that the crossing of the cable within such region is selectively chosen, and hence, the position of the ring-like handgrip is selectively chosen. Movement of the ring-like handgrip translates the cable which in turn upwardly translates at least one of the weights mounted on the frame. Means for converting mechanical energy to electrical energy may be operatively connected to a different, moving element of the machine to produce electrical energy when the machine is used for exercise.

BRIEF DESCRIPTION OF THE DRAWINGS

The invention will be described with reference to the accompanying drawings, wherein.

DESCRIPTION OF A PREFERRED EMBODYMENT

Figure 1:
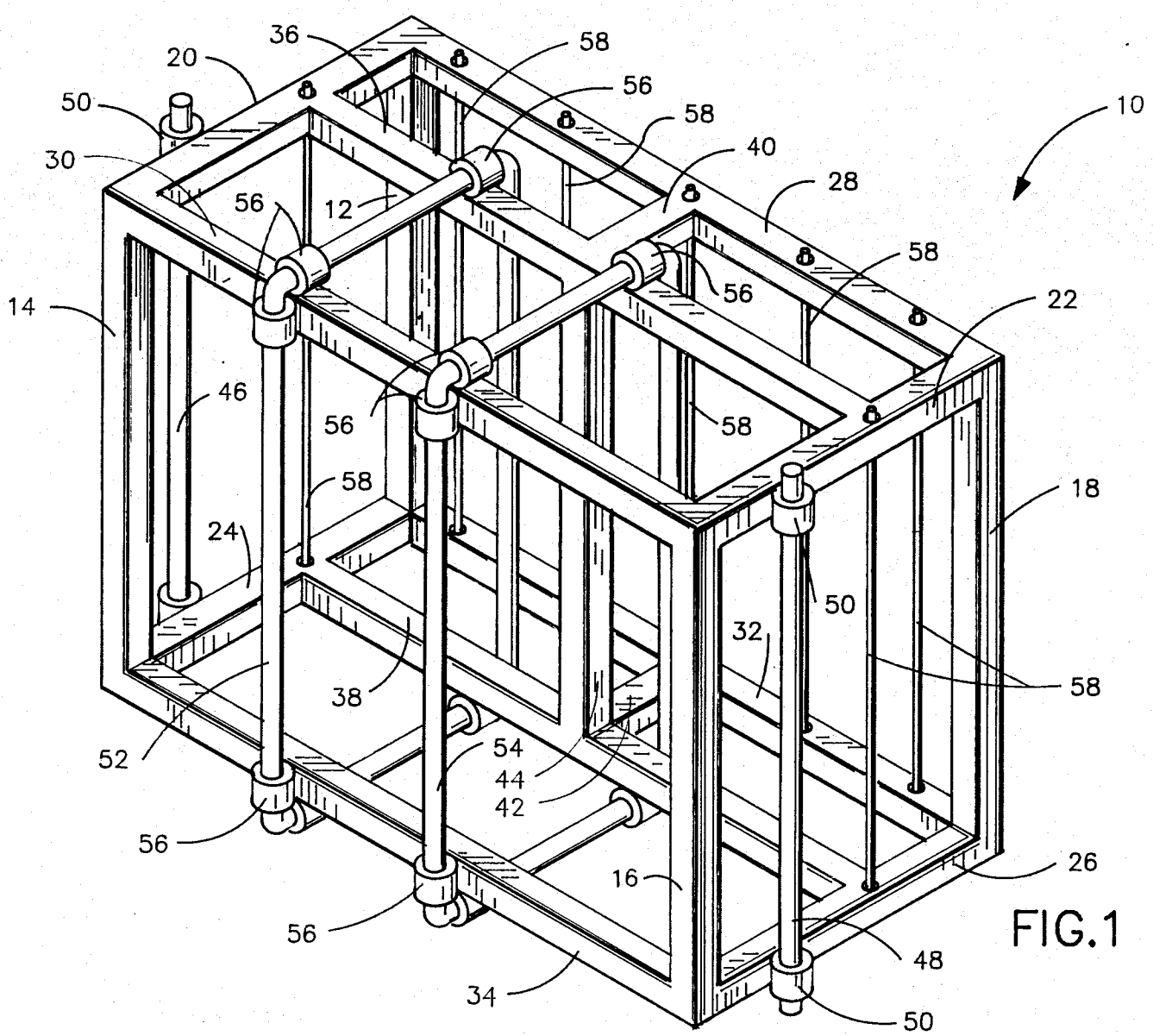
FIG. 1 is a perspective view of a frame that may be utilized in accordance with one embodiment of an exercise machine of the present invention.

Referring now to the drawings wherein like reference numerals and symbols refer to the same item, there is shown in FIG. 1 a frame 10 that may be utilized in accordance with one embodiment of an exercise machine according to the present invention. The frame 10 is sufficiently large to contain comfortably a person using the exercise machine. Although the frame can be generally of any configuration, the frame 10 is preferably generally cubic, as shown in FIG. 1. The framework preferably comprises a sturdy and strong material such as steel or aluminum in the form of pipes, "L"-bars, rods, or the like. The framework may be welded together or may comprise pipes, etc. threadably coupled together for quick assembly and disassembly.

The frame 10 includes four vertically extending end beams 12, 14, 16 and 18. Each end of the frame 10 includes a top laterally extending beam 20, 22 and includes a bottom laterally extending beam 24, 26. Each side of the frame 10 includes a top longitudally extending beam 28, 30 and includes a bottom longitudally extending beam 32, 34. The top of the frame 10 includes a central beam 36 longitudally extending between the top laterally extending beams 20 and 22. The bottom of the frame 10 includes a central beam 38 longitudally extending between the bottom laterally extending beams 24 and 26. A first short beam 40 centrally, laterally extends between the top longitudally beam 28 and the top central beam 36; and a second short beam 42 centrally, laterally extends between the bottom longitudally extending beam 32 and the bottom central beam 38. A central post 44 centrally, vertically extends between the top central beam 36 and the bottom beam 38. The central post 44 may be padded with a resilient material such as foam rubber to protect the user of the exercise machine, especially when the machine is used in a mode of operation for constant resistance.

Each end of the frame 10 includes a vertically extending, laterally translatable bar 46, 48. The bars 46, 48 engage the laterally extending frame members 20, 22, 24 and 26 through means of rollers 50 or the like. The function of the translatable bars 46, 48 will be described hereinafter.

The frame 10 also includes a pair of rectangular shaped, looping bars 52, 54 which tightly surround the top central beam 36, the bottom central beam 38, the bottom longitudally extending beam 34 and the top longitudally extending beam 30, with each looping bar 52, 54 disposed on a corresponding longitudinal side of the central post 44. The looping bars 52, 54 are longitudally translatable along the aforesaid beams 36, 38, 34 and 30, which they surround. The looping bars 52, 54 may contact these four beams by means of rollers 56 or the like.

FIG. 1 also shows the frame 10 including seven vertically extending rods 58. The bottoms of each of the rods 58 rest in a corresponding hole or depression in one of the bottom beams 24, 26 and 32, whereas the tops of the rods 58 extend through corresponding holes provided in the top beams 20, 22 and 28.

Figure 6:
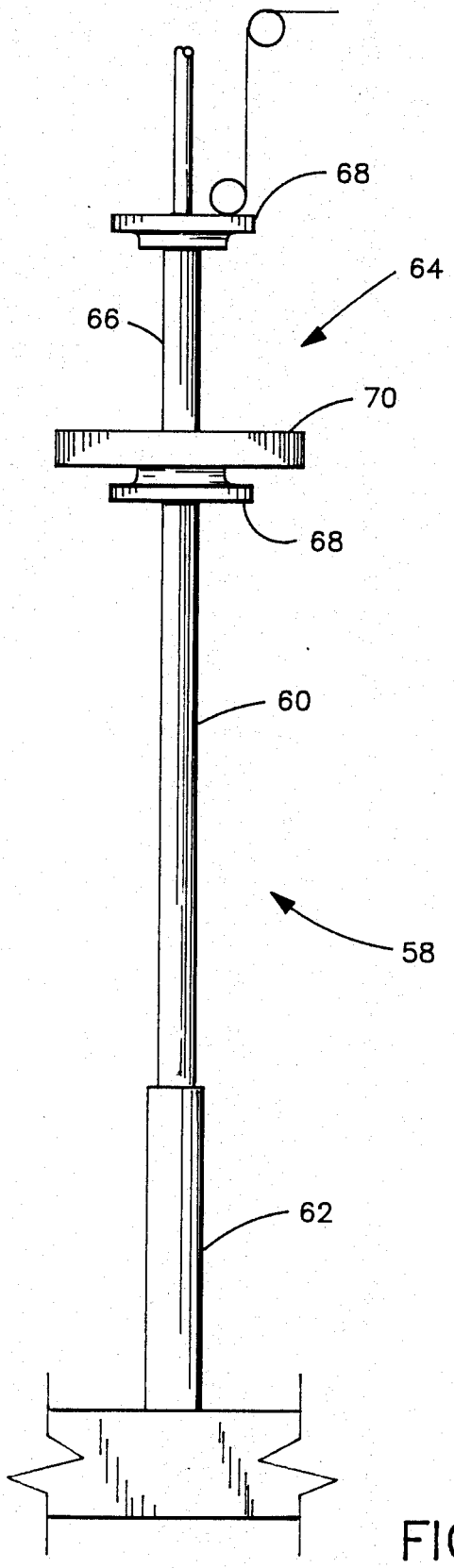
FIG. 6 is a side view of a portion of the frame depicted in FIG. 1 having a vertically translatable weight mounted thereon.

The rods 58 are adapted for ready disattachment from the other frame components and, as especially shown in FIG. 6, preferably are comprised of two sections, a relatively long upper section 60 and a relatively larger diameter bottom section 62. The top end of the lower section 62 may be hollowed to receive the lower end of the relatively narrower upper section 60. The rods 58 are designed to guide and support a vertically translatable weight 64. As shown in FIG. 6, the weight 64 may include a tube 66 mounted about the rod 58, a pair of end caps 66 each mounted on a corresponding end of the tube 66 and provided with apertures therein so that the rod 58 extends therethrough. The weight 64 further includes a relatively heavy disk 70 having a central aperture therethrough, which disk is adapted for mounting about the tube 66 and is limited in its translation along the tube 66 by the end caps 68. The disk 70 may comprise a standard weight for a barbell. The mass of the weight 64 may be varied by removing the upper end cap 66 and placing any number and sizes of disks 70 about the tube 66. The tube 66 is long relative to the thickness of the heavy disk 70 so that a selective number of heavy disks 70 may be mounted about the tube 66, thereby permitting the user to select a wide range of different masses for the weight 64.

A compression spring may be mounted about the lower member 62 of the rod 58 so as to cushion and prevent the weight 64 from forceably contacting any of the various beams of the frame 10.

Each of the rods 58 is adapted to guide and have mounted thereon a corresponding weight 64. It should be apparent from the discussion that follows that various embodiments of the present invention may utilize different numbers of rods 58 and weights 64.

Basically, the weights utilized in any embodiment of the present invention are interconnected by means of a cable or cable segments. The cable is suspended in a generally taut condition along a selected path about the frame 10. Such cable suspension may be accomplished by several pulleys mounted at various selected locations about the frame 10. Preferably, the pulleys are readily attached and disattached to the frame 10, and preferably at least some of the pulleys, are translatable along the various frame components.

The frame 10 is designed such that the user of the exercise machine may be positioned adjacent to the vertical post 44 between the center bottom beam 38 and the lower bottom beam 34. The cable is suspended along a path around the frame 10 such that cable path passes the region in which the user customarily is positioned. To exercise, the user simply translates the cable along its path, which in turn will raise at least one of the weights to which the cable is connected.

A variety of means may be utilized to assist the user in translating the cable. Two such means are shown in FIGS. 7 and 8.

Figure 7:
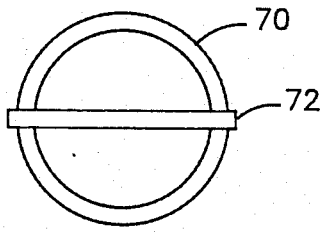
FIG. 7 is a side view of a hand ring utilized in accordance with an embodiment of an exercise machine of the present invention.
Figure 9:
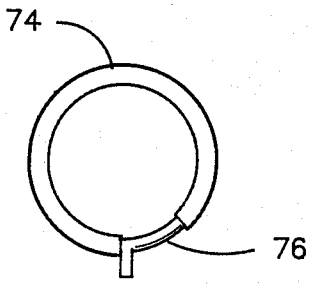
FIG. 9 is a side view of a locking ring which may be utilized in accordance with an embodiment of an exercise machine of the present invention.

FIG. 7 depicts a ring 70 having a bar 72 extending diagonally there across, each end of the bar 72 provided with a hole therein through which the ring 70 extends. The cable may be attached to the ring 70 by any means, or the ends of cable segments may be attached to the ring 70 by any means. The cable segment ends may be provided with loops or links for quick attachment and disattachment to the ring 70. As shown in FIG. 9, a well known clasping ring 74 may be utilized for quick attachment and disattachment of the loop or link of the cable segment end to the ring 70. The clasping ring 74 in a well known construction is provided with a spring biased closing segment 76 which may be manually displaced against the spring bias to provide an opening in the ring 74 through which the loop or link of the cable segment end may pass. Thus, a user of the exercise machine may grasp the ring 70 by the bar 72 extending diagonally thereacross to translate the cable or the cable segments.

Figure 8:
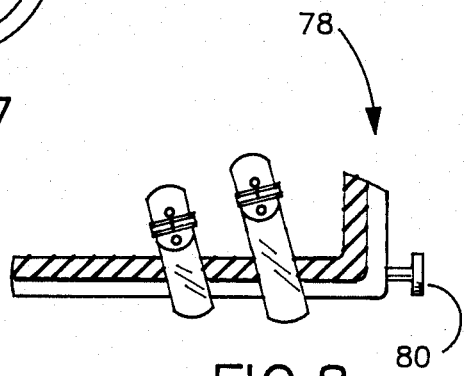
FIG. 8 is a side view of a specially adapted shoe utililzed in accordance with an embodiment of an exercise machine of the present invention.

FIG. 8 depicts yet another means that may be utilized by a user to assist him in translating the cable or the cable segment. FIG. 8 shows a shoe 78 which may be strapped to the foot of the exercise machine user. The outside of the shoe is formed of a relatively hard material such as plastic or metal and the inner surface of the shoe preferably is formed of a soft resilient material such as rubber. Located at the heel of the shoe or at any other location of the shoe is a relatively short T-bar 80 formed again of a relatively hard material. The T-bar 80 is adapted to receive a ring such as the clasping ring 74 about its neck section, with the head of the T-bar being of a sufficient length so that the clasping ring 74 is retained about the neck of the t-bar 80 during exercising.

Figure 10:
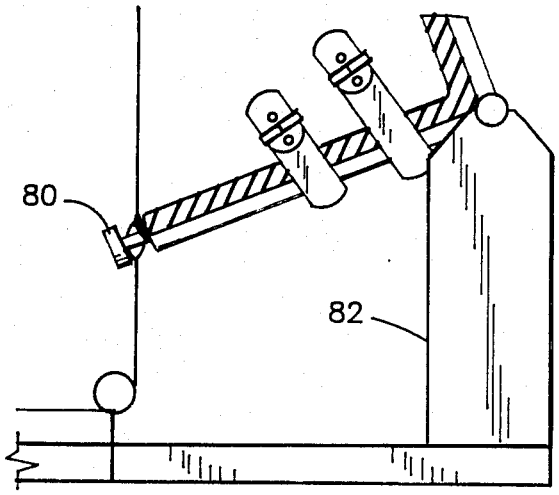
FIG. 10 is a side view of a specially adapted shoe pivotable about its heel utilized in accordance with an embodiment of an exercise machine of the present invention.

FIG. 10 depicts the shoe shown in FIG. 8 being pivotably mounted about its heel on a pedestal 82. The shoe in FIG. 10 has the T-bar 80 located at the toe of the shoe whereby muscles exerted in raising and lowering the front portion of one's foot are exercised.

As previously stated, the cable path passes the region of the exercise machine in which the user thereof is customarily located. The position of the pulleys about the frame 10 are selected on the basis of the exercise to be performed by the user and to a certain degree on the physical size of the user. For example, if the user wishes to exercise his arm muscles, he may want the cable path to cross such region either at waist level or at shoulder level.

Figure 2:
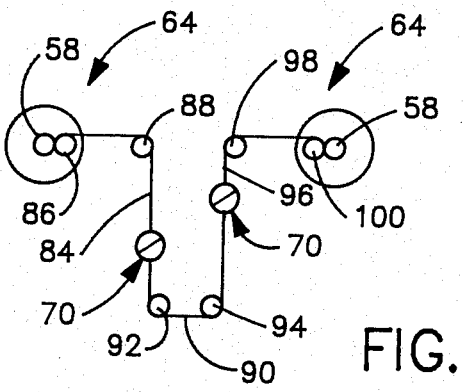
FIG. 2 comprises a schematic top view illustrating a weight, cable, pulley, and hand ring system utilized in accordance with one embodiment of an exercise machine of the present invention.

One of the simplest modes of operation of the exercise machine of the present invention is depicted in FIG. 2. In this mode of operation, two weights 64 are mounted about corresponding rods 58. One end of a first cable segment 84 is attached to one weight 64. The cable segment 84 then extends upwardly around a pulley 86 and then downwardly around a pulley 88 located at approximately waist level. The cable segment 84 then extends to a ring 70 whereat one end of the cable segment 84 is attached to the ring 70. One end of a second cable segment 90 is also attached to the ring 70. The second cable segment then passes around a pulley 92 located at approximately waist level and then around another pulley 94 located at waist level and then extends to a second ring 70 whereat the other end of the cable segment 90 attaches to the second ring 70. An end of a third cable segment 96 attaches to the second ring 70. The third cable segment 96 extends around a pulley 96 located at waist level, then upwardly around a pulley 100 and downwardly where it is attached to the other weight 64. It should be obvious from the foregoing that the various pulleys mentioned could be mounted about the frame 10 in such positions as to locate the rings 70 almost in any desired position. By the selective positioning of the rings 70, the user of the exercise machine may engage in a variety of exercises.

From the mode of operation depicted in FIG. 2, it will be appreciated that movement of a ring 70 in either direction along the path of the cable or the cable segments will result in one of the weights 64 being raised and the other weight being lowered. If the weights 64 are of approximately the same mass, then each ring 70 will remain stationary unless a force is applied by the user against a ring 70. The user must exert a force to move the ring 70 in either direction along the path of the cable or the cable segment. The force which the user must exert to move a ring 70 and thereby translate the cable or cable segments and hence lift at least one of the weights may be varied by varying the mass of the weights 64.

The principal of operation of the mode depicted in FIG. 2 demonstrates in a simplistic manner the concept of inertial resistance. By contrast, constant resistance may be achieved in the mode of operation depicted in FIG. 2 by simply eliminating the second cable segment 90, such as by disattaching the ends of the cable segment 90 from each of the rings 70. Thus, it should also be appreciated that the mode of operation depicted FIG. 2, as well as other modes of operation yet to be described, may be readably adapted to achieve either constant resistance or inertial resistance for exercising.

Figure 3:
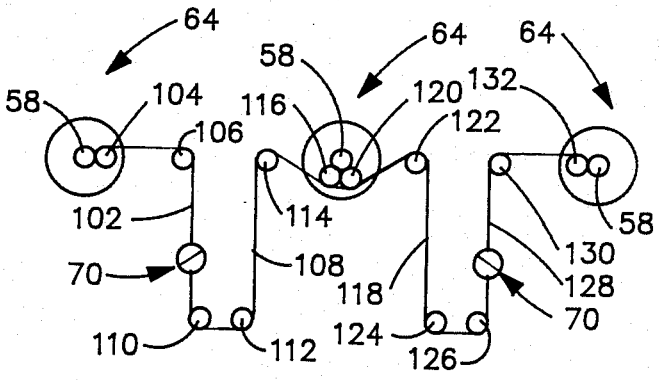
FIG. 3 is a schematic top view illustrating a weight, cable, pulley and hand ring system of another embodiment of an exercise machine of the present invention.

In the mode of operation depicted in FIG. 2 one of the rings 70 will move in one direction whereas the other ring will move in the opposite direction during exercise. The mode of operation depicted in FIG. 3 is a modification of the mode of operation depicted in FIG. 2, wherein the user moves the rings 70 concurrently in the same direction, such as forward, to achieve the effect of inertial resistance. In the mode of operation depicted in FIG. 3, three weights 64 are utilized. The centermost weight 64 has approximately twice the mass of each of the outside weights 64.

In FIG. 3 a first cable segment 102 has an end thereof attached to an outside weight 64. The cable then passes around a relatively high pulley 104, then around a pulley 106 located about waist high, and then travels to a ring 70 where an end of the cable segment 102 attaches to the ring 70. A second cable segment 108 has an end thereof attached to the ring 70, then the cable segment 108 passes around a pulley 110 located at waist level and then around a pulley 112 located at a relatively high position, then around a pulley 112 located at a relatively high position, then around a pulley 114 located at a relatively high position, and finally the cable segment 108 is attached to the center weight 64. A third cable segment 118 has an end thereof attached to the center weight 64, then the cable segment 118 passes around a pulley 120 located at a relatively high position, around a pulley 122 located at a relatively high position, then around a pulley 124 located at a relatively high position, around a pulley 126 located at waist level, and finally an end of the cable segment 118 attaches to the other ring 70. A fourth cable segment 128 has an end thereof attached to the other ring 70, then the cable segment 128 passes around a pulley 130 located at waist level, then around a pulley 132 located at a relatively high position, and finally the other end of the cable segment 128 attaches to a weight 64. It will be appreciated that the user of the exercise machine standing between the rings 70 does not experience any interference with the cable segments 108 and 118 because they follow a path located well above the user's head.

Instead of having the ends of the cable segments 108 and 118 attach to the center weight 64, the cable segments 108 and 118 may comprise one continuous cable segment that passes around a pulley attached to the center weight 64.

The modes of operation depicted in FIG. 2 and FIG. 3 involve inertial resistance in a single dimension. By using more weights, pulleys and cable or cable segments, inertial resistance may be achieved in two or three dimensions, as depicted in FIGS. 4 and 5, respectively.

Figure 4:
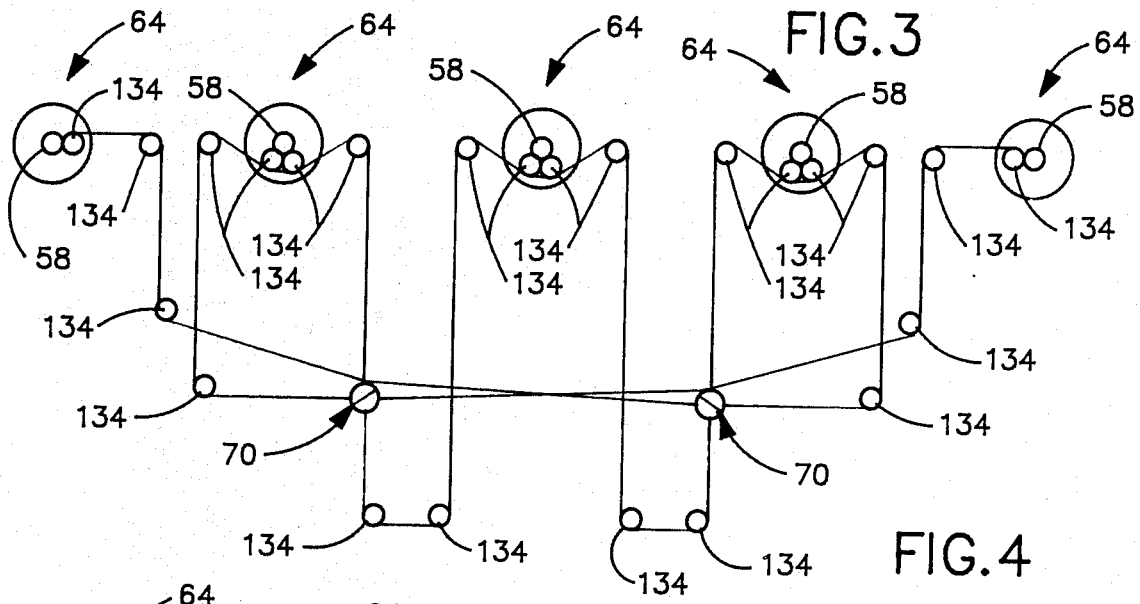
FIG. 4 is a schematic top view illustrating a weight, cable, pulley, and hand ring system for yet another embodiment of an exercise machine of the present invention.
Figure 5:
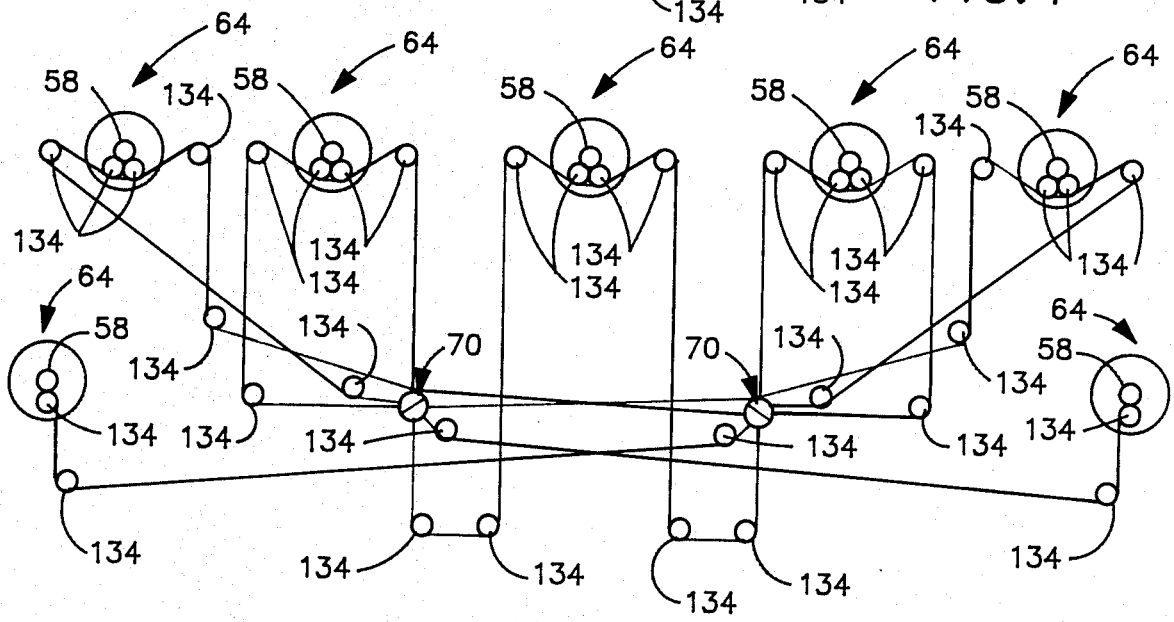
FIG. 5 is a schematic top view illustrating a weight, cable, pulley, and hand ring system in accordance with still another embodiment of an exercise machine of the present invention.

FIG. 4 depicts a mode of operation in which inertial resistance is accomplished in two dimensions, each of which is in a horizontal plane. The mode of operation of FIG. 5 depicts inertial resistance in three dimensions. For purposes of convenience, the pulleys depicted in FIGS. 4 and 5 have been designated with the number 134 and the cable or cable segments are shown as lines and have not been designated with any numeral. It will be appreciated that the modes of operation depicted in FIG. 4 and FIG. 5 utilize pulleys positioned at various locations about the frame 10 so that the cable or cable segments connect with the rings 70 but do not interfere with the user during exercising.

In the modes of operation depicted in FIGS. 2 through 5, the masses of the weights 64 utilized in each mode may be chosen so that the rings 70 remain stationary except when a force is applied to the rings. Again, certain cable segments may be eliminated to accomplish a constant resistance mode of operation in one or more dimensions.

It is preferable that the pulleys directing the various corresponding cable segments to the rings 70 are attached to one of the translatable bars 46, 48, 52 and 54 of the frame 10. Such mounting of the pulleys allows the user to move either ring 70 in a direction other than along a path of the cable or cable segments, such as at a forty-five degree angle to one of the cable segments, and still experience inertial resistance. When the user moves the rings in such a direction, the translatable bars 46, 48, 52 and 54 will translate relative to the stationary frame elements.

It should be understood that a shoe such as depicted in FIG. 8 could be utilized instead of the rings 70 depicted in FIGS. 2 through 5, in which event, the various pulleys would be mounted at appropriate heights, etc. for such use. Moreover, a complementary set of weights, pulleys, and cables may be utilized in addition to the systems already depicted in FIGS. 2 through 5 so that a user of the exercise machine may utilize both rings 70 and shoes 78 simultaneously. Also, it should be appreciated that the pulleys may be positioned about the frame 10 so as to accomodate different physical sizes of users of the exercise machine.

Since the lengths of cable segments may not always equal the length of the desired cable path, the present invention contemplates the use of a winch or like means upon which a portion of the cable segment may be reeled, thereby permitting the length of the cable segment to be varied and insuring that the cable segment is maintained in a taut condition regardless of the selected cable path.

It is also contemplated in the present invention that means for converting mechanical energy to electrical energy may be operatively connected to any moving part of the exercise machine so that use of the exercise machine produces electrical energy. Such means and coupling are well known to those skilled in the art.

Figure 11:
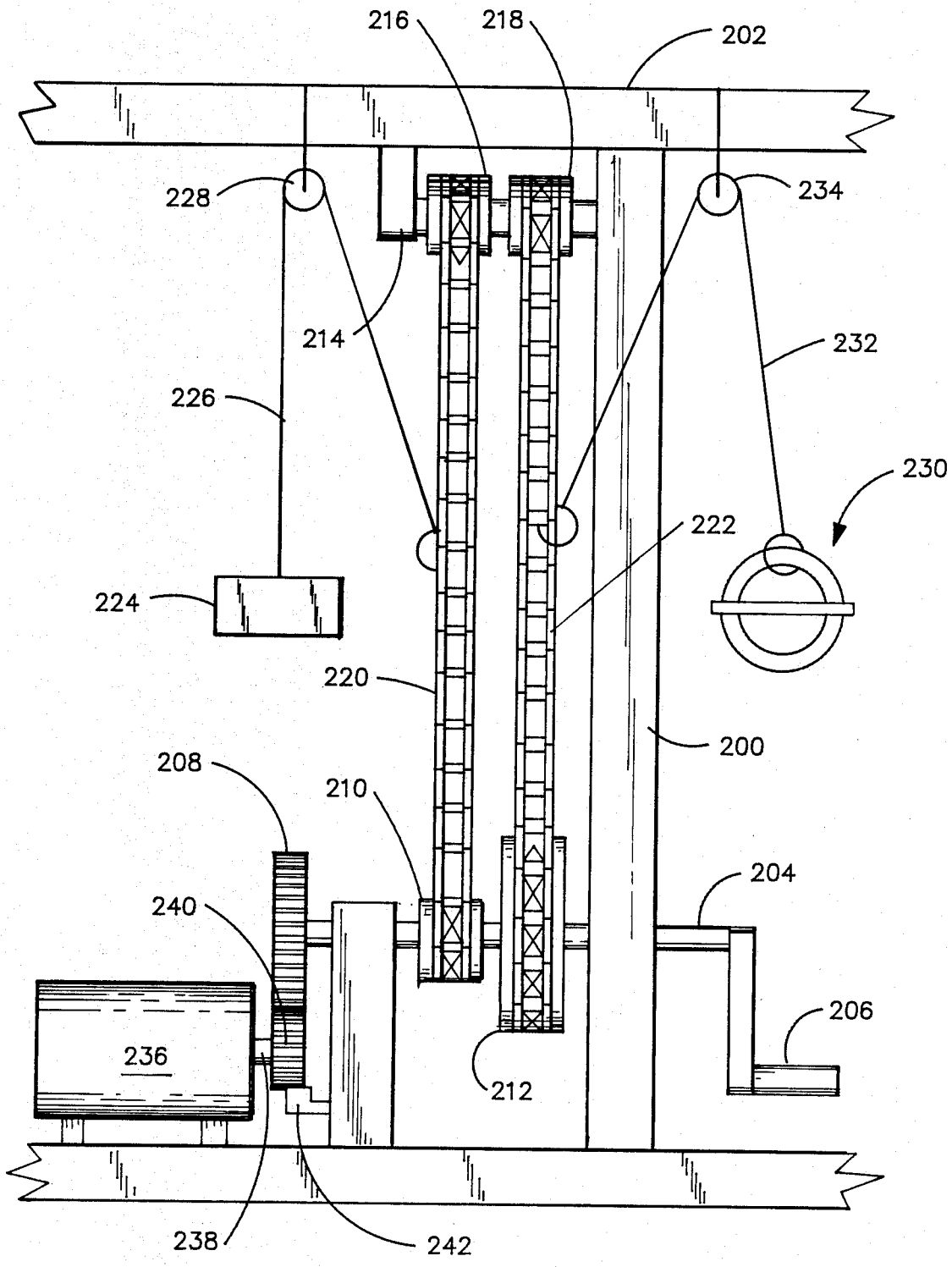
FIG. 11 is a plan view of an exercise machine according to one embodiment of the present invention.

Another variation of the exercise machine of the present invention is depicted in FIG. 11. The exercise machine depicted in FIG. 11 includes a frame having a vertical post 200 and a top, horizontally extending, cross beam 202. Mounted on the lower portion of the vertical post is an axle 204 rotatable with respect thereto. One end of the axle is provided with a handle 206 for manual rotation of the same, and the other end of the axle is provided with an axle sprocket 208. Fixedly mounted on the axle 204 intermediate its ends is a first sprocket 210 and a second sprocket 212 of a diameter larger than the first sprocket 210. The first sprocket 210 and the second sprocket 212 are fixedly mounted on the axle 204. A second axle 214 is fixedly mounted at the top portion of the vertical post 200. A third sprocket 216 and a fourth sprocket 218 of approximately equal diameter are rotatably mounted on the second axle 214. A first endless chain 220 wraps around and intermeshes with the first sprocket 210 and the third sprocket 216 for concurrent rotation therewith. The second endless chain 222 wraps around and intermeshes with the second sprocket 212 and the fourth sprocket 218 for concurrent rotation therewith. The exercise machine also includes a relatively heavy mass or weight 224 connected through a cable or the like 226 to the first endless chain 220. The cable 226 passes over a pulley 228 mounted on the cross beam 202, whereby the weight 224 is suspended. A ring 230 similar in all respects to the ring 70 is connected through a cable 232 to the second endless chain 222. The cable 232 passes over a second pulley 234 mounted on the cross beam 202, whereby the ring 230 is suspended.

The exercise machine depicted in FIG. 11 also preferably includes a device 236 for converting mechanical energy into electrical energy. The device 236 may be any conventional device, but preferably includes an armature 238 having mounted on an end thereof a sprocket 240 that intermeshes with and rotates concurrently with the sprocket 208 mounted on the end of the first axle 204.

In operation, vertical displacement of the ring 230 causes a concurrent displacement of the weight 224. In the exercise machine as depicted, the machine operates in a mode of constant resistance. To insure that the ring 230 will not move when a force ceases to be applied by a user, a paul 242 may operatively engage the armature sprocket 240 to prevent rotation of the same in one direction of rotation and hence to prevent movement of the weight 224 and the ring 230. The paul 242 may be reversible so that either of the two directions of rotation of the armature sprocket 240 may be selectively prevented.

The difference of diameter of the first sprocket 210 and the second sprocket 212 produces a gear effect so that by varying such diameter difference, such as by utilizing second sprockets of different diameters, the ring 230 may be moved with different degrees of resistance while utilizing the same weight 224. In this context the first and second sprockets 210, 212 may be removably mounted on the axle 204 or the second sprocket 212 may comprise a group of several sprockets of different diameters with means for selectively shifting the second endless chain 222 into operative contact with each of the several sprockets.

In place of the ring 230, a barbell or the like may be utilized. When such a barbell of an appropriate mass relative to the mass of the weight 224 is utilized, the exercise machine depicted in FIG. 11 operates in an inertial resistance mode so that the barbell will not vertically displace unless a force is exerted thereon by the user. In such an inertial resistance mode of operation, there is no need for a paul 242.

Although particular embodiements of the present invention have been described and illustrated herein, it should be recognized that modifications and variations may readily occur to those skilled in the art and that such modifications and variations may be made without departing from the spirit and scope of our invention. Consequently, out invention as claimed below may be practiced otherwise than as specifically described above.

I claim:

1. A machine for use in exercising a human body comprising:

a frame;

a first sprocket mounted on and rotatable relative to said frame;

a second sprocket mounted on and rotatable relative to said frame;

an axle mounted on and rotatable relative to said frame;

a third sprocket fixedly mounted on said axle;

a fourth sprocket fixedly mounted on said axle;

a first endless chain intermeshing with said first sprocket and said third sprocket and a second endless chain intermeshing with said second sprocket and said fourth sprocket whereby said first, second, third and fourth sprockets rotate concurrently;

a weight connected to and suspended by said first endless chain, whereby concurrent rotation of said first, second, third and fourth sprockets causes a concomitant vertical displacement of said weight; and means for causing concurrent rotation of said first, second, third and fourth sprockets, said rotation causing means connected to said second endless chain and said rotation causing means adapted for forceful contact with a limb of the user's body.

2. A machine according to claim 1 wherein at least one of said first, second, third and fourth sprockets possesses a diameter different from the others of said first, second, third and fourth sprockets.

3. A machine according to claim 1 further comprising means for arresting the rotation of said sprockets in at least one direction of rotation.

4. A machine according to claim 1 further comprising means for converting mechanical energy to electrical energy, said converting means operably interconnected to said first, second, third and fourth sprockets.

5. A machine according to claim 1 wherein said rotation causing means comprises a barbell.

6. A machine for use in exercising a human body comprising:

a frame;

an endless belt means of high strength material supported by said frame and translatable along a substantially fixed path in a substantially vertical plane;

a barbell connected to and suspended by said endless belt means;

a weight adapted to be selectively connected to and suspended by said endless belt means; and means for selectively connecting said weight to and suspending said weight from said endless belt means, such that when said weight is unconnected and unsuspended to said endless belt means, when a substantially upward force applied to the barbell encounters constant resistance from the barbell, and such that when said weight is connected to and suspended from said endless belt means, then said weight moves substantially upward when said barbell moves substantially downward and said weight moves substantially downward when said barbell moves upward, and such that when said weight is connected to and suspended from said endless belt means then a substantially vertical force applied to the barbell encounters inertial resistance from the barbell.

7. A machine according to claim 6 further comprising means for arresting the translation of said endless belt means.

8. A machine according to claim 6 further comprising means for converting mechanical energy to electrical energy, said converting means operably interconnected to said endless belt means.

9. A machine according to claim 6 further comprising a first pulley mounted on said frame and a first cable operably engaging and partially surrounding said first pulley wherein said barbell is connected to and suspended by said endless belt means by means of said first cable and said first pulley and wherein said selective connecting and suspending means includes a second pulley mounted on said frame and a second cable operably engaging and partially surrounding said second pulley.

* * * * *